United States Patent [19]

Ciaccio

[11] Patent Number: 4,804,113

[45] Date of Patent: Feb. 14, 1989

[54] SALT AND PEPPER SHAKER

[75] Inventor: Richard J. Ciaccio, Wrentham, Mass.

[73] Assignee: Dart Industries Inc., Deerfield, Ill.

[21] Appl. No.: 67,585

[22] Filed: Jun. 26, 1987

[51] Int. Cl.[4] ..... A47G 19/24

[52] U.S. Cl. ..... 222/142.1; 222/480; 222/151; 222/543; 220/254

[58] Field of Search ..... 222/142.1–142.7, 222/144.5, 480, 481, 482, 151, 485, 543; 215/6; 220/254, 259, 22

[56] References Cited

U.S. PATENT DOCUMENTS

| | | | |
|---|---|---|---|
| 1,260,208 | 3/1918 | Kline | 222/142.1 |
| 2,618,413 | 11/1952 | Brooks . | |
| 2,992,501 | 7/1961 | Douglas . | |
| 3,139,920 | 6/1964 | Irwin et al. . | |
| 3,185,359 | 5/1965 | Buntic . | |
| 3,186,540 | 6/1965 | Breger . | |
| 3,187,964 | 6/1965 | Foster . | |
| 3,251,509 | 5/1966 | Foster . | |
| 3,254,811 | 6/1966 | Harris . | |
| 3,256,892 | 6/1966 | Esposito, Jr. . | |
| 3,342,380 | 9/1967 | Smith . | |
| 3,409,188 | 11/1968 | Wright . | |
| 3,485,416 | 12/1969 | Fohrman | 222/142.1 |
| 3,542,235 | 11/1970 | Hidding . | |
| 3,587,944 | 6/1971 | Pehr . | |
| 4,284,200 | 8/1981 | Bust et al. | 220/254 |

FOREIGN PATENT DOCUMENTS

| | | | |
|---|---|---|---|
| 844981 | 8/1939 | France | 222/151 |
| 2544 | 12/1912 | United Kingdom | 222/151 |

OTHER PUBLICATIONS

"Star", Mar. 27, 1983, Page 16—"Why Didn't I Think of That? Bright Ideas From Kansas City Inventors".

*Primary Examiner*—H. Grant Skaggs

*Attorney, Agent, or Firm*—John A. Doninger

[57] ABSTRACT

A two-chambered dispensing receptacle with a pair of closure assemblies integrally molded therewith. Each closure assembly includes a shaker top integrally hinged to the wall of one chamber at diametrically opposed portions of the receptacle. Each closure assembly further includes a closure lid integrally hinged to the shaker top for pivotal movement relative thereto. Each shaker top selectively closes and seals the adjoining chamber with the associated closure lid overlying the shaker top of the other closure assembly and selectively sealing dispensing openings defined therethrough.

19 Claims, 2 Drawing Sheets

FIG. 1
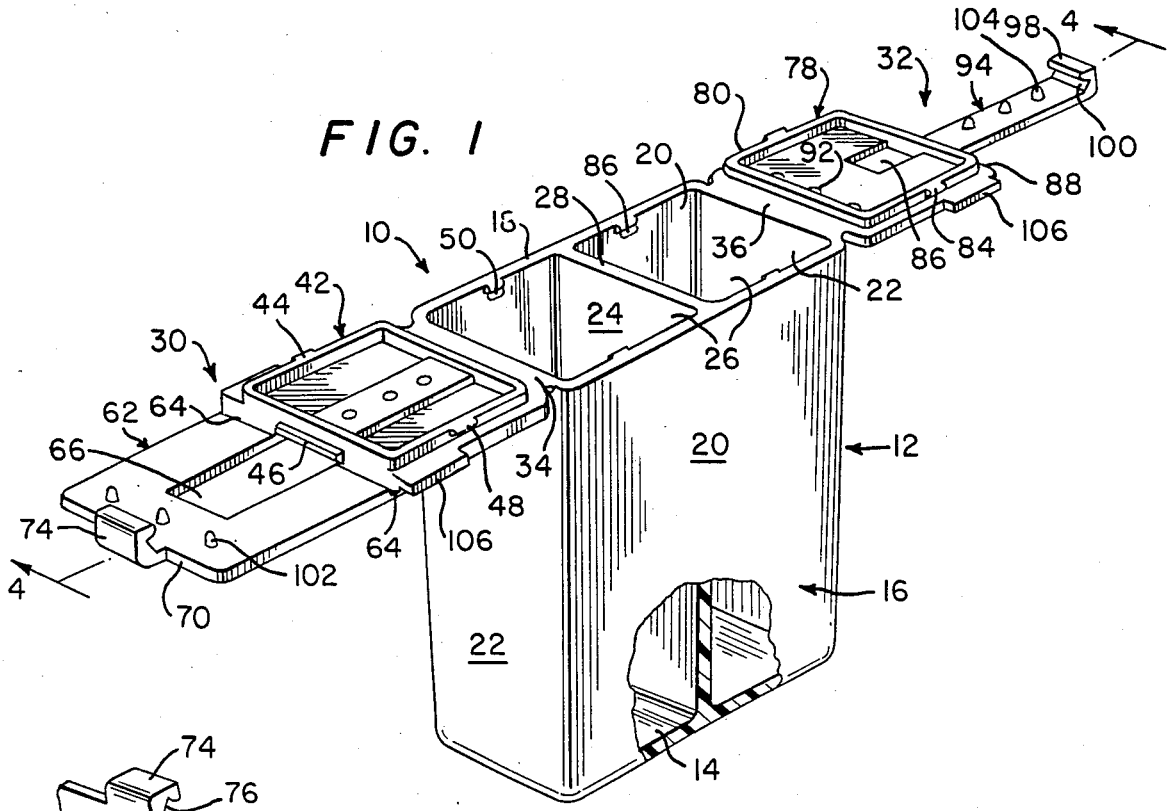
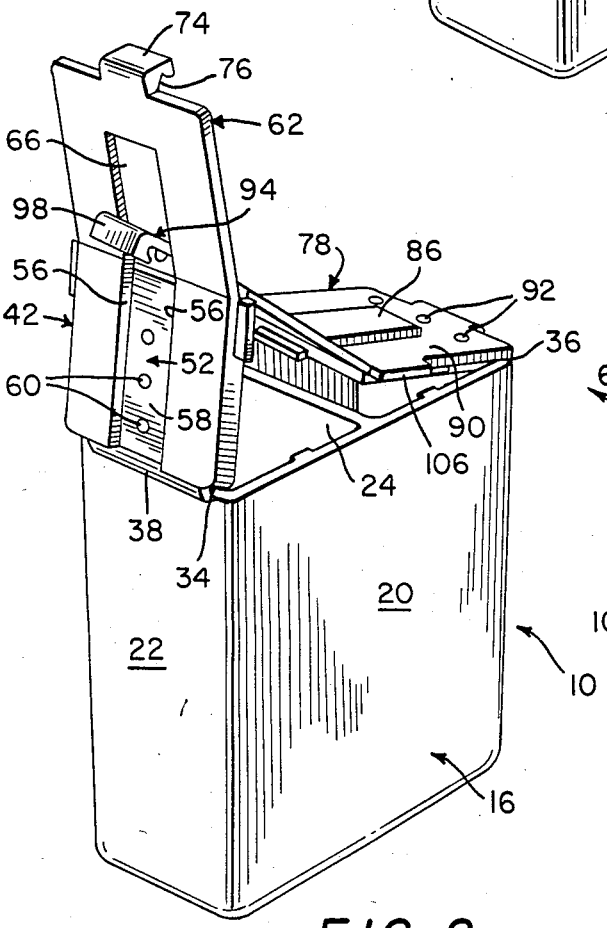
FIG. 2
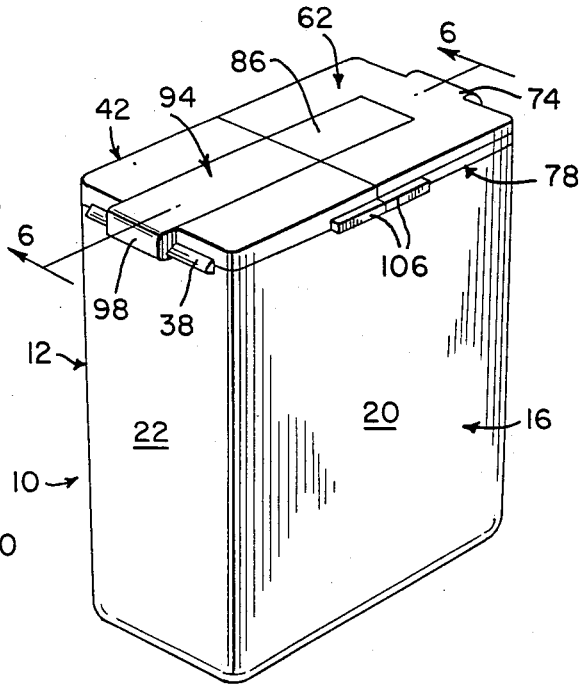
FIG. 3

SALT AND PEPPER SHAKER

BACKGROUND OF THE INVENTION

The invention is generally concerned with the packaging and dispensing of flowable condiments, for example salt and pepper.

Provision for the dispensing of such condiments has normally entailed use of separate shaker containers, the conventionally known salt shaker and pepper shaker which appear, in one form or another, on substantially every dining table. Such shakers are provided in an almost endless variety, from elaborate crystal and metal shakers to disposable singleserve paper containers.

As a matter of convenience and reduced expense, dual chamber dispensers have also been devised wherein each of the chambers includes a different condiment and is provided with a separate closure for selectively allowing and restricting flow therefrom.

It is also known to form shakers, particularly inexpensive and/or single-use shakers, of an appropriate synthetic resinous material or plastic.

SUMMARY OF THE INVENTION

The dispenser of the present invention is a molded one-piece, two-chamber container particularly adapted to store, segregate and individually dispense two distinct flowable materials, for example salt and pepper.

The molded container, of an appropriate plastic or synthetic resinous material such as polyvinylchloride, polyethylene, polypropylene, or the like, includes, as integral molded components thereof, both the basic two-chamber container or receptacle and dual closure assemblies. The dual closure assemblies foldably interact to close the chambers and provide dispensing assemblies. Each dispensing assembly, in turn, incorporates a sprinkler or shaker chamber top and a closure lid therefor.

The actual receptacle or container portion of the dispenser includes a closed bottom, preferably rectangular, with a peripheral wall projecting upwardly therefrom and terminating in an upper edge defining an open top. A transverse interior partition wall, of equal height with the peripheral wall and extending generally centrally across the interior of the receptacle, divides the interior of the receptacle into two upwardly opening chambers. In a container of rectangular configuration, the transverse partition wall will parallel a pair of opposed end walls.

Integrally hinged to and along the upper edge of each of the end walls is a closure assembly including a sprinkler or shaker top adapted to sealingly seat within the adjacent or proximal chamber top and engage on the upper edge of the intermediate partition wall. Each closure assembly also includes, integrally hinged to the outer edge of the corresponding shaker top, a closure lid which is adapted to engage over and cooperate with the chamber-seated shaker top of the opposite closure assembly. The two lids, in order to move into overlying relationship with the corresponding shaker tops, will be defined by interdigitating panels selectively narrower than the full width of the shaker tops in order to bypass each other. Each of the shaker tops includes dispensing holes therethrough with the overlying lids including hole-sealing and cleaning projections.

Each shaker top and the overlying closure lid or cap comprises a dispensing assembly for the chamber sealed thereby, the combined shaker top and overlying closure lid presenting a planar upper surface. In furtherance thereof, the dispensing holes will be provided within a recess defined in the upper surface of the corresponding shaker top which conforms to the configuration, including thickness, of the overlying lid.

Each lid includes, at the outer free end thereof, a depending latch which, upon a closing of the lid, is specifically adapted to engage and releasably lock to a projecting rib or lip defined by the hinge securing each closure assembly along the corresponding portion of the top edge of the receptacle.

Other features and advantages of the invention will become apparent as the details of construction and manner of use are more fully hereinafter presented.

BRIEF DESCRIPTION OF THE DRAWINGS

FIG. 1 is a perspective view of the dispenser fully open and as molded, a portion being broken away for purposes of illustration;

FIG. 2 is a perspective view of the dispenser partially closed;

FIG. 3 is a perspective view of the dispenser fully closed;

DESCRIPTION OF PREFERRED EMBODIMENT

Figure 4:
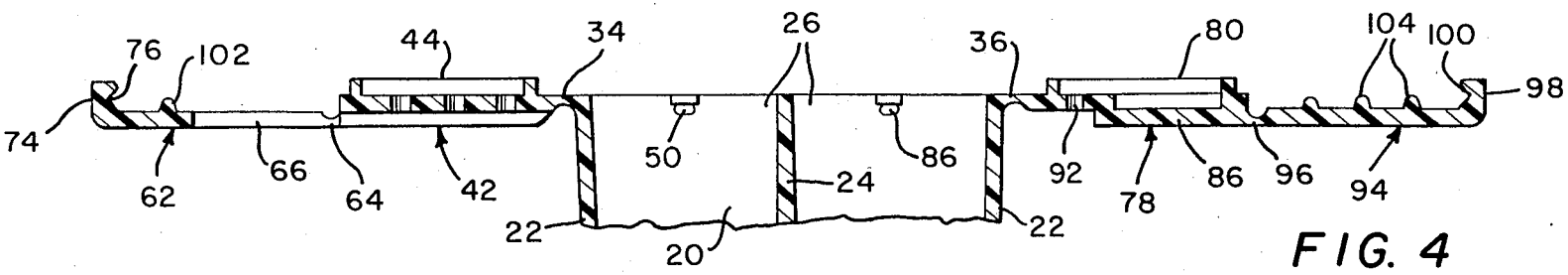
FIG. 4 is an enlarged cross-sectional detail taken substantially on a plane passing along line 4—4 in FIG. 1.

Referring now more specifically to the drawings, reference numeral 10 is used to generally designate the dispenser or dispensing receptacle comprising the present invention. The receptacle 10 is specifically configured in a manner whereby all of the components thereof are injection molded as an integral unit with living hinges defined between the components for selected manipulation thereof. The actual material of the dispenser or receptacle may be any of several appropriate plastics or synthetic resins including polyethylene, polypropylene, polyvinylchloride, or the like susceptible to molding and capable of providing both a structurally stable container and integral flexing hinges. The material, assuming the dispensing of a food product, is to be compatible with foodstuffs.

Noting FIG. 1 in particular, the dispensing receptacle includes a container 12 having a closed bottom 14 with a peripheral wall 16 rising vertically therefrom and terminating in a continuous peripheral top edge 18 defining a top container opening.

The container 12 is preferably rectangular in cross-section with the peripheral wall 16 defining a pair of substantially parallel side wall portions 20 with relatively narrower end wall portions 22 extending therebetween.

A full height internal partition wall 24 is integrally formed with the side wall portions 20 and extends transversely therebetween, dividing the interior of the container 12 into two substantially duplicate full height chambers 26, each provided with a top chamber opening defined by the peripheral top edge 18 and the coplanar top edge 28 of the partition wall 24.

First and second closure assemblies 30 and 32 are integrally joined to the peripheral top edge 18 along the length thereof corresponding to the end wall portions 22 by means of substantially full length integrally molded hinges 34 and 36 respectively. Noting the various cross-sectional views, the hinges 34 and 36 can be slightly undercut to facilitate the desired flexing or pivotal movement. Further, each of the hinges 34 and 36 is so configured as to, in the completely folded positions of the closure assemblies 30 and 32, define elongate outwardly projecting ribs or lips 38 and 40 along the respective top edge portions for reasons which shall be explained subsequently.

The first closure assembly 30 includes a shaker or sifter top 42 immediately adjacent and integral with the hinge 34. This shaker top is adapted to seal the immediately adjacent or proximal chamber 26 and is dimensionally of a size to overlie the corresponding portion of the peripheral top edge 18. In order to effect a positive sealing of the open top of the chamber 26, the shaker top 42 includes a depending peripheral skirt 44 which is closely received within the open chamber top peripherally thereabout. The outer wall of the skirt 44, relative to the hinge 34, is coplanar with the outer edge of the shaker top 42 and adapted to lie immediately inward of the partition wall 24. A projecting flange 46 extends integrally from the central portion of this outer edge of the shaker top 44 to partially overlie the top edge 28 of the intermediate partition wall 24. The inner wall of the skirt 44, as well as the opposed side walls thereof, are inwardly offset from the edges of the shaker top, enabling the top to overlie the corresponding portions of top edge 18 with the skirt 44 engaged within the chamber. Frictional retention of the skirt 44 within the open chamber top is enhanced by a pair of projecting lugs 48 on the outer faces of the opposed side walls of the skirt 44 which engage within corresponding notches or recesses 50 defined immediately below minor rounded protuberances on the inner faces of the opposed portions of the container wall 16 adjacent the top edge thereof.

The upper surface of the shaker top 42 includes a central recess 52 longitudinally thereacross for the full length of the shaker top 42 from the inner integral hinge 34 to the outer transverse edge 54 from which the lip or flange 46 projects. The recess 52 is of a transverse width approximately one-third that of the shaker top 42 and is of a rectangular configuration with opposed parallel edges 56 with a planar bottom 58. The transverse edge flange 46 has a transverse length approximately equal to the width of the recess 52 and constitutes, in the top view of the recess, a planar continuation thereof.

The shaker top 42 is completed by the provision of a plurality of dispensing holes 60, preferably three, at spaced points centrally along the recess 52. These holes communicate with the interior of the associated chamber 26 upon a closure of the shaker top 42 and allow for a dispensing of the contents of the chamber.

The closure assembly 30 further comprises a closure lid or cap 62 including a longitudinal inner edge joined to the outer edge 54 of the shaker top 42 by an integral hinge 64. The hinge 64 is actually defined in two longitudinal sections, one to each side of the shaker top recess 52.

Figure 6:
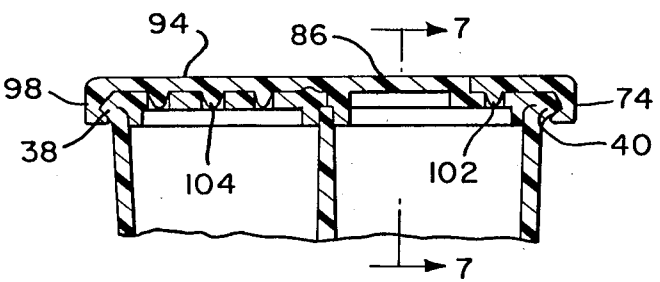
FIG. 6 is a transverse cross-section taken substantially on a plane passing along line 6—6 in FIG. 3.

The closure lid 62, which is of a length and width substantially equal to that of the associated shaker top 42, includes a central elongate opening or aperture 66 defined therethrough. The aperture 66 is of a width approximating that of the shaker top recess 52 and extends in linear alignment therewith from the hinge-mounted inner edge of the closure lid 62. The aperture 66, of a substantially rectangular configuration, defines two generally equal width side panels 68, each of which is in turn approximately one-third of the transverse width of the closure lid 62. The aperture 66 terminates inward of the free outer edge 70 of the closure lid 62 to define a transverse panel 72 integral between the outer end portions of the side panels 68 and of substantially equal width therewith, forming basically a U-shaped lid configuration. The thickness of the closure lid 62 is substantially equal to the depth of the recess 52. The closure lid 62 is completed by a latch 74 integrally joined with and projecting both outwardly and laterally downward from the free outer edge 70. The latch 74 includes an internal undercut portion 76 which, as will be best appreciated from FIGS. 3 and 6, is adapted to snap-lock over the remote folded hinge 36 and the rib 40 formed thereby, as shall be explained in more detail subsequently.

The second closure assembly 32 includes a shaker or sifter top 78 which has an inner edge joined to the adjoining top edge portion of the corresponding end wall 22 by the substantially full length hinge 36 integrally molded therebetween and therewith.

The shaker top 78 is of a basic rectangular configuration corresponding to that of the adjacent chamber 26 so as to overlie the chamber and the portion of the peripheral top edge 18 which defines this chamber. For additional support of the shaker top 78, it is also contemplated that the outer edge portion of this top at least partially overlie the top edges 28 of the partition wall 24.

In order to enhance the sealing of the upper end of the corresponding chamber 26, a depending flange or skirt 80 is formed integrally with the undersurface or bottom face of the shaker top 78 in inwardly spaced relation to the peripheral edge of the top 78. This skirt 80 is received within the corresponding chamber 26 and generally frictionally engaged with the wall portions thereof. The edge portions of shaker top 78, outward of skirt 80, overlie and seat on the corresponding portions of top edge 18. A releasable locking of the shaker top 78 in the chamber-closing position thereof is enhanced by the provision of a pair of locking lugs 84 extending outwardly from the opposed longitudinally directed side walls of the skirt 80, these lugs snap-locking within appropriate notches or recesses 86 defined within the inner faces of corresponding chamber wall portions immediately below minor rounded protuberances adjacent the top edge.

The upper face or top surface of the shaker top 78 includes a raised rectangular central portion 86 which corresponds in configuration, including height, to the aperture or opening 66 in the closure lid 62 for a complementary reception within this aperture 66 upon a closing of the closure lid 62 over the shaker top 78, as shall be explained presently.

The raised central portion 86, extending inward from the outer edge 88 of the shaker top 78, terminates in spaced relation to the inner hinge-connected edge to basically define a U-shaped recess 90 which conforms in size and shape to the U-shaped configuration of the closure lid 62. Appropriate dispensing openings 92, for example three, are provided at equally spaced points through the shaker top 78 transversely thereacross within that portion of the recess 90 between the hinge 36 and the raised portion 86.

It will thus be recognized that the dispensing openings 60 of the first shaker top 42 extend centrally and longitudinally of the shaker top 42 within a recess 52 defined in the upper surface thereof, and thus longitudinally across the associated chamber 26. The dispensing openings 92, positioned transversely across the shaker top 78 within a recess 90 formed in the upper surface thereof, extend transversely across the corresponding chamber 26 adjacent the outer end wall thereof.

The closure assembly 32 includes a second closure lid 94 of elongate rectangular configuration with a width substantially equal to that of the upper surface projection 86 on the corresponding shaker top 78. The closure lid 94 is pivotally joined to the shaker top 78 by integral hinge 96 and comprises an integral continuation of the projection 86, coplanar therewith for engagement through the central rectangular aperture 66 of the first closure lid 62, as noted in FIG. 2, and into closely conforming reception within the elongate rectangular recess 52 of the first shaker top 42. The closure lid 94 is of a thickness equal to the depth of the recess 52 so as to, in the closed position of the entire assembly, define a planar outer surface.

The outer end of the closure lid or panel 94 includes an integral laterally extending latch 98, depending in the closed position of the latch. This latch 98 includes an inwardly directed undercut portion 100 which is adapted to releasably snap-lock over the innermost integral hinge 34, and the rib 38 formed thereby, associated with the first closure assembly 30.

In each case, the closure lids 62 and 94 cover and seal the respective dispensing openings 92 and 60. This sealing can be enhanced, and provision made to automatically clean the openings, by the incorporation of integral projections 102 and 104 respectively extending from the undersurfaces of the closure lids 62 and 94 and appropriately positioned thereon to engage within the corresponding openings.

As will be recognized, the closure lid 62 from the first closure assembly 30 overlies and cooperates with the shaker top 78 of the second closure assembly 32 to combine therewith in defining a dispensing assembly for one of the chambers 26. Similarly, the closure lid 94 of the second closure assembly overlies the shaker top 42 of the first closure assembly 30 and defines therewith a second dispensing assembly associated with the second chamber 26. The interdigitating relationship between the closure lids 62 and 94 enable these lids to overlie and cooperate with opposing shaker tops 78 and 42 respectively with each closure assembly 30 and 32 extending across the entire open top of the container 12, providing, through the cooperating opening-containing recesses 52 and 90, a planar upper surface. In fact, substantially the only disruption in the smooth exterior of the dual-chambered dispensing receptacle 10 is the two opposed latches 74 and 96 adapted for finger-manipulated release of the hinged closure lids 62 and 94. As desired, minor lifting flanges 106 can integrally project from opposed side edges of the tops 42 and 78 to assist in opening these tops for refilling or the like.

Figure 5:
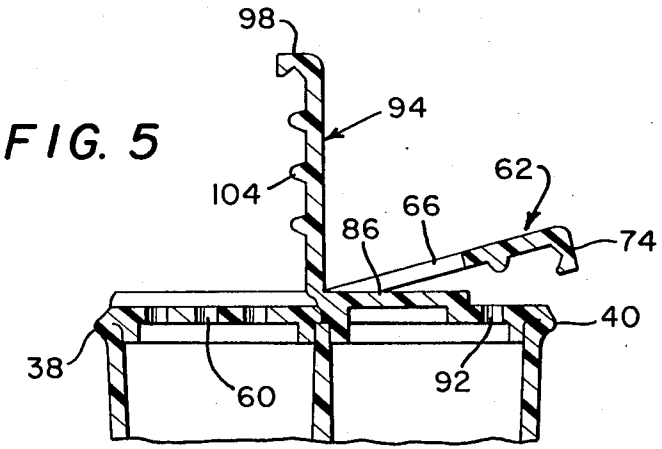
FIG. 5 is a cross-sectional view with one closure lid fully open for dispensing and the other closure lid partially open for purposes of illustration only.
Figure 7:
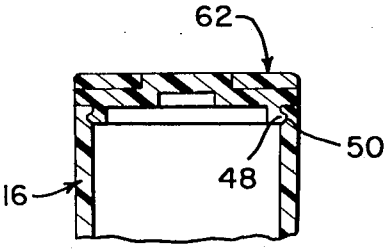
FIG. 7 is a transverse cross-sectional view taken substantially on a plane passing along line 7—7 in FIG. 6.

As suggested in FIG. 5, each of the lids is adapted to hingedly pivot between an open dispensing position and a chamber-closing position. While normally only one lid will be open at any one time, the relationship of the closure lids is such whereby each of the individually manipulable lids can be opened or closed regardless of the position of the other lid.

The crossing relationship of the lids is significant in that each lid cooperates with and is manipulable relative to the shaker top of the opposed closure assembly. Thus, when as an example only lid 94 is manipulated, shaker top 42 is retained and stabilized in its closed position both by its direct engagement with and within the associated chamber 26, and by the integral lid 62 latched into position over the opposed shaker top 78.

As will be appreciated, all of the component parts of the dispenser or dispensing receptacle are configured for injection molding as a single unit, thus providing for substantial economies in manufacture. Further, notwithstanding the one-piece construction of the receptacle, each of the chambers of the receptacle is provided with a complete dispensing assembly including a closure lid and a shaker top independently hinged in a manner whereby the closure lid can be moved to an open position to expose the shaker top for a discharge of the material, while the shaker top itself can be pivotally moved to an open position to completely expose the chamber for refilling or the like.

I claim:

1. A dispensing receptacle for storing and selectively dispensing diverse flowable materials, said receptacle comprising wall means defining plural adjacent chambers, each chamber having a top opening, a plurality of closure assemblies, each closure assembly including a shaker top selectively received within and sealing the top opening of one of said chambers, each closure assembly further including a closure lid and a hinged joinder between the closure lid and the shaker top of the closure assembly, each closure lid being selectively received in overlying relation to an opening-received shaker top of another closure assembly to define a dispensing assembly therewith, each said shaker top including hole means therethrough, each closure lid closing the hole means of the shaker top overlaid thereby, in each dispensing assembly the closure lid being pivotally movable between a closed position closing the hole means of the associated shaker to an open position allowing flow through these hole means.

2. The dispensing receptacle of claim 1 including means pivotally joining each shaker top to the wall means immediately adjacent the chamber top opening within which it is selectively received for pivotal movement of each closure assembly, including the shaker top, and associated lid, between a first position remote from said top openings and a second position overlying said top openings.

3. The dispensing receptacle of claim 2 wherein said means pivotally joining each shaker top to the wall means comprises a first hinge integrally formed with and joining the shaker top and the wall means, said hinged joinder between the closure lid and shaker top of each closure assembly comprising a second hinge integrally formed with and joining the closure lid and shaker top of the closure assembly.

4. The dispensing receptacle of claim 3 wherein two vertical chambers are defined, said wall means comprising a peripheral wall and an internal partition wall extending centrally between opposed portions of said peripheral wall, defining the two chambers to the opposite sides thereof.

5. The dispensing receptacle of claim 4 wherein the closure lid in each closure assembly comprises elongate panel means extending longitudinally outward of the corresponding shaker top from an inner end engaged with the shaker top by said hinged joinder and terminating in a free outer edge, the panel means of the two closure lids, in the closed positions thereof, extending in parallel laterally adjacent relation to each other.

6. The dispensing receptacle of claim 5 wherein the panel means of said closure lids bypass and interdigitate with each other upon pivotal movement of each closure assembly from the first position thereof remote from the top openings to the second position overlying the top openings.

7. The dispensing receptacle of claim 6 wherein the outer end of each closure lid panel means includes a latch, said first hinge integrally joining each shaker top and the wall means defining a projecting lip upon reception of the adjacent shaker top within the adjacent chamber top opening, each latch, in the closed position thereof, releasably engaging one of said lips.

8. The dispensing receptacle of claim 7 wherein, the hole means in each of said shaker tops defines a different hole pattern.

9. The dispensing receptacle of claim 8 wherein the hole pattern in one shaker top comprises a series of holes longitudinally spaced centrally along the one shaker top, the second hole pattern comprising a series of holes spaced transversely across the second shaker top.

10. The dispensing receptacle of claim 9 including sealing means on each closure lid comprising a series of hole-receivable projections aligned for reception within the holes of the corresponding shaker top in each defined dispensing assembly.

11. The dispensing receptacle of claim 6 wherein the panel means of one of said closure lids comprises a pair of laterally spaced panels with a transverse panel integral with and transversely between the outer end portions of the pair of panels remote from the hinged joinder, said laterally spaced panels defining an elongate panel opening therebetween, the panel means on the other of said closure lids comprising a single elongate panel slidably receivable through the panel opening of the one closure lid upon movement of said closure assemblies between the first and second positions thereof.

12. The dispensing receptacle of claim 11 wherein each shaker top includes an upwardly directed recess defined therein and dimensionally corresponding to the overlying closure lid panel means in each of the defined dispensing assemblies, whereby each dispensing assembly defines a planar upper surface in the closed position of the closure lids, said hole means being defined through the shaker tops in the recesses therein.

13. A dual dispensing receptacle with integral closures for storing, segregating and selectively dispensing two flowable material; said receptacle comprising a container having an interior defined by a peripheral wall, said peripheral wall terminating in a peripheral top edge, said peripheral top edge defining a top container opening, an interior partition wall dividing the interior of said container into two chambers, said interior partition wall having a transverse partition top edge dividing the top container opening into a top chamber opening for each chamber, a pair of shaker tops, one associated with each chamber for sealing reception within the corresponding chamber opening, each shaker top including material dispensing hole means therethrough, each shaker top being joined to the peripheral top edge by first folding holder means integral with the shaker top and the peripheral top edge for movement of the shaker top between positions opening and closing the corresponding chamber opening, a pair of closure lids associated with said shaker tops for selective closing of the dispensing hole means therethrough, second folding hinge means integrally joining each closure lid with one of said shaker tops, and each closure lid integrally joined to each shaker top, in the closing position thereof, overlies and closes the dispensing hole means of the other shaker top.

14. The dispensing receptacle of claim 13 wherein the dispensing hole means of each shaker top comprises a distinct hole pattern, each closure lid including projection means receivable within the corresponding hole pattern in the closing position of the closure lid.

15. The dispensing receptacle of claim 14 wherein said closure lids include panels which interdigitate between the opening and closing positions of the closure lids.

16. The dispensing receptacle of claim 15 wherein said shaker tops are joined to said peripheral top edge at opposed portions thereof and, in the closing positions thereof, have adjacent inner edges longitudinally overlying the partition top edge, said closure lids extending in opposite directions to each other from the inner edges of the respective shaker tops joined thereto, each in substantial alignment with the respective joined shaker top and in overlying relation to the other shaker top.

17. The dispensing receptacle of claim 16 wherein each shaker top includes an upper surface with a recess of predetermined depth defined therein, the corresponding dispensing hole means extending through the shaker top within the recess, the closure lid integral with each shaker top being substantially coextensive with and receivable within the recess of the other shaker top in the closing position.

18. The dispensing receptacle of claim 17 including releasable latch means on each closure lid for releasably maintaining each closure lid in the closing position thereof.

19. The dispensing receptacle of claim 18 wherein each of said first folding hinge means, in the closing position of the corresponding shaker top, defines an outwardly projecting rib along the portion of the peripheral top edge integral with the first folding hinge means, each said latch means including a portion thereof snap-locking with one of said projecting ribs.

* * * * *